US007815269B2

(12) United States Patent
Wenning et al.

(10) Patent No.: US 7,815,269 B2
(45) Date of Patent: Oct. 19, 2010

(54) REFRIGERATOR

(75) Inventors: Udo Wenning, Giengen/Brenz (DE); Hermann Stegmaier, Böbingen/Rems (DE); Rudolf Schmidt, Giengen (DE); Irena Sonnenfroh, Giengen/Brenz (DE); Hans-Frieder Eberhardt, Giengen-Burgberg (DE); Michael Neumann, Giengen/Brenz (DE); Jörg Stelzer, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 59 days.

(21) Appl. No.: 10/117,848

(22) Filed: Apr. 8, 2002

(65) Prior Publication Data

US 2002/0153817 A1 Oct. 24, 2002

Related U.S. Application Data

(63) Continuation of application No. PCT/EP00/09733, filed on Oct. 5, 2000.

(30) Foreign Application Priority Data

Oct. 6, 1999 (DE) ..... 199 48 361

(51) Int. Cl.
*A47B 96/04* (2006.01)

(52) U.S. Cl. ..... 312/406; 312/401; 312/405

(58) Field of Classification Search ..... 312/400, 312/401, 406, 405, 406.1; 62/296, 298; 52/309.8, 52/309.9; 428/319.7
See application file for complete search history.

(56) References Cited

U.S. PATENT DOCUMENTS

| | | | | | |
|---|---|---|---|---|---|
| 3,966,283 | A * | 6/1976 | Puterbaugh | ..... | 312/406 |
| 4,707,401 | A * | 11/1987 | Benford | ..... | 428/319.7 |
| 5,009,952 | A * | 4/1991 | Klepsch et al. | ..... | 428/319.7 |
| 5,118,174 | A * | 6/1992 | Benford et al. | ..... | 312/406 |
| 5,418,055 | A * | 5/1995 | Chen et al. | ..... | 428/319.7 |
| 5,632,543 | A * | 5/1997 | McGrath et al. | ..... | 312/406 |
| 5,669,232 | A * | 9/1997 | Iwamoto et al. | ..... | 62/296 |
| 5,730,516 | A * | 3/1998 | Vismara | ..... | 312/406 |
| 5,890,785 | A * | 4/1999 | Vismara | ..... | 312/406 |
| 6,305,768 | B1 * | 10/2001 | Nishimoto | ..... | 312/406 |

FOREIGN PATENT DOCUMENTS

| | | | | | |
|---|---|---|---|---|---|
| EP | 0 434 225 | A1 | | 6/1991 | |
| GB | 729392 | | | 5/1955 | |
| JP | 05157446 | A | * | 6/1993 | ..... 62/447 |
| JP | 06213559 | A | * | 8/1994 | ..... 62/298 |
| JP | 10205989 | A | * | 8/1998 | |
| WO | 9834077 | | * | 8/1998 | |

* cited by examiner

*Primary Examiner*—Hanh V Tran
(74) *Attorney, Agent, or Firm*—James E. Howard; Andre Pallapies

(57) ABSTRACT

A refrigerator includes a heat-insulating housing and at least one heat-insulating door fastened thereto. The door and the housing each have an outer cladding, an inner cladding, and a heat insulation layer produced therebetween by foaming and into which is introduced vacuum insulation panels on the door and/or on the housing. Vacuum insulation panels are disposed on the inner claddings of the doors and housings.

6 Claims, 2 Drawing Sheets

REFRIGERATOR

CROSS-REFERENCE TO RELATED APPLICATION

This application is a continuation of copending International Application No. PCT/EP00/09733, filed Oct. 5, 2000, which designated the United States.

BACKGROUND OF THE INVENTION

Field of the Invention

The invention relates to a refrigerator with a heat-insulating housing and with at least one heat-insulating door fastened to the housing, the door and the housing having an outer cladding, an inner cladding, and a heat insulation layer produced therebetween by foaming and into which are introduced vacuum insulation panels on the door and/or on the housing.

In prior art refrigerators, such as, for example, chill cabinets and freezers, vacuum insulation panels are disposed in their heat insulation to lower the energy consumption of these refrigerators. Various techniques are adopted in the configuration and are clearly defined for fixing the vacuum insulation panels within the heat insulation. One of the fixing possibilities is to secure the vacuum insulation panels to the smooth-surfaced outer claddings of the doors and housings on refrigerators, such outer claddings, therefore, being particularly suitable for fixing the normally likewise smooth-surfaced vacuum insulation panels. For such a purpose, before the heat insulation foam is introduced, the vacuum insulation panels are secured to the outer claddings by an adhesive joint. In such a type of fastening, because of the different coefficients of expansion between the heat insulation material of the vacuum insulation panels and the actual heat insulation foam, normally based on polyurethane, it may, however, happen that the outer claddings exhibit visible distortions after the curing process of the heat insulation foam. To remedy such a problem, the outer claddings formed from thin-walled lacquered sheet metal are reinforced over a large area, on the heat-insulation side, by additional sheet-metal or plastic plates. Such a measure, in addition to increasing the material costs and the weight of the appliance, results in an appreciable rise in costs. A further advantage of the above-described type of mounting of the vacuum insulation panels is that a degree of covering of the housing walls of only about 60-70 percent is achieved thereby.

In the prior art refrigerators, for manufacturing reasons, the vacuum insulation panels were disposed on the housing and door outer claddings due to their smooth-surfaced construction. These configurations have a relatively low degree of covering and, consequently, relatively inefficient heat insulation.

To avoid the disadvantages associated with such mounting of the vacuum insulation panels, a different method has been adopted of placing these panels between the inner cladding and the outer cladding so as to virtually float in the foaming heat insulation material. In such an introduction of the vacuum insulation panels, however, care must be taken to ensure that, during the foaming process of the heat insulation material, the panels do not change their position in an unfavorable way to prevent the foaming of the heat insulation material due to the formation of a kind of "foam brake", with the result that the complete filling of the space to be insulated is no longer ensured. To ensure complete foaming in the case of vacuum insulation panels disposed in a floating manner, the panels have been fixed by filling positioning aids within the interspace with foam between the inner and the outer cladding. During such a fixing, in addition, care must be taken to ensure that the distance from the inner cladding or the outer cladding to the vacuum insulation panels does not fall below a specific minimum distance from one of the claddings, thus, being detrimental to the foaming of the heat insulation material.

SUMMARY OF THE INVENTION

It is accordingly an object of the invention to provide a refrigerator that overcomes the hereinafore-mentioned disadvantages of the heretofore-known devices of this general type and that mounts vacuum insulation panels in refrigerators to increase the energy efficiency thereof and to reduce the manufacturing outlay associated with the introduction of the vacuum insulation panels into the heat insulation of the refrigerator housings.

With the foregoing and other objects in view, there is provided, in accordance with the invention, a refrigerator including a heat-insulating housing, at least one heat-insulating door moveably fastened to the housing, the door and the housing each having an outer cladding, an inner cladding, and a foam-produced heat insulation layer disposed between the outer cladding and the inner cladding, the inner cladding having a heat-insulation side with a panel area, at least one of the door and the housing having a vacuum insulation panel in the heat insulation layer at the panel area of the heat-insulation side of the inner cladding, the vacuum insulation panel having a panel surface with a shaping, and a surface adaptation adapting a surface shaping of the panel area at least approximately to the shaping of the panel surface on the at least one of the door and the housing.

To rectify disadvantages of the prior art, the invention proposes to dispose the vacuum insulation panels on the inner claddings of the doors and housings, for which purpose either coupling elements bridging the gaps of the inner claddings and making it possible to mount the vacuum insulation panels or surface deformations provided according to the gaps on the inner cladding on the vacuum insulation panels are disposed.

By associating the vacuum insulation panels with the inner cladding of a refrigerator housing or of a refrigerator door, particularly, in the case of a refrigerator housing, the degree of covering is markedly increased, as compared with the outer cladding. As a result, the efficiency of the heat insulation is improved and, consequently, the energy consumption of a refrigerator is appreciably reduced. The manufacture of the refrigerator housings and refrigerator doors is simplified considerably because the vacuum insulation panels are disposed intrinsically with a clearance on the inner cladding (caused by the unplanar surface thereof that results, for example, from the unevennesses produced by the integral forming of carrying aids, for example, carrying strips for holding refrigerated-product shelves or evaporator tiers or else also by the integral forming of a condensation-water outflow). Such is true with the invention because, on one hand, manufacturing measures for the prevention of distortions on their outer claddings do not have to be taken.

On the other hand, there is also no need for positioning measures to ensure minimum distances of the vacuum insulation panels from the outer and inner cladding to ensure that the interspaces produced by the vacuum insulation panels are completely filled with foam.

It is particularly simple to mount the vacuum insulation panels exactly in position within the interspace, filled with heat insulation material, between the inner and the outer cladding, particularly, in terms of large-series manufacture, when, in accordance with another feature of the invention, the adaptation is disposed on the vacuum insulation panels. Simple mounting results from the fact that, when the vacuum insulation panels are mounted on the inner cladding, additional measures for adapting these to the surface shapes of the inner cladding do not have to be taken.

In accordance with a further feature of the invention, the surface adaptation is an at least approximately heat-insulating intermediate layer between the panel area of the heat-insulation side of the inner cladding and the vacuum insulation panel.

By using an intermediate layer compensating the surface shapes on the inner cladding, it is possible for the vacuum insulation panels to have a planar construction even at the interface with the intermediate layer. As a result, the vacuum insulation panels are of planar construction on both sides and can, therefore, be produced particularly simply. Furthermore, the intermediate layers provide the possibility of restriction substantially to one type of vacuum insulation panel because, by virtue of the appropriate shaping of the intermediate layers, adaption to different surface structures of the inner claddings is possible. Therefore, a kind of standardization of the vacuum insulation panels is brought about by the intermediate layers. As a result, the configuration variations of such vacuum insulation panels are markedly reduced. Consequently, by virtue of the markedly reduced type diversity, the quantities of one type are markedly increased and, therefore, this type can be produced particularly cost-effectively. Moreover, the heat-insulating construction of the intermediate layer prevents a reduction in the heat insulation capacity of the door or housing.

In accordance with an added feature of the invention, the intermediate layer is produced by a separate molding that serves as coupling element between the vacuum insulation panels and the inner cladding. By use of separate moldings as an intermediate layer, it is possible to select this specifically to requirements in a particularly accurate way, for example, as regards the selection of material in terms of its heat insulation capacity.

According to an alternative embodiment of the subject of the invention, the intermediate layer is formed by a heat insulation foam that is applied in liquid form to the inner cladding and onto which, in the still liquid state, the vacuum insulation panels are placed. Such a construction results in particularly intensive adaption and contacting of the vacuum insulation panels to the inner cladding. Such adaption of the vacuum insulation panels to the surface shapes of the inner cladding also allows reliable adaption to complicated surface structures of the inner cladding.

In accordance with an additional feature of the invention, the vacuum insulation panels have at least one side that in terms of its surface shape is adapted at least approximately to the surface shape of the location of assignment on the inner cladding. By adapting the vacuum insulation panels directly to the surface shapings of the inner cladding, such vacuum insulation panels can quickly be secured, accurately in position, to the inner cladding, directly and, therefore, without any barrier.

In accordance with yet another feature of the invention, the surface shape of the vacuum insulation panels is produced by the non-cutting shaping of their supporting bodies formed from glass fiber or silicic acid or aerogels. By using supporting bodies formed from glass fiber, silicic acid, or aerogels, the adaption of these to the surface shaping of the inner cladding by non-cutting forming is particularly beneficial.

In accordance with yet a further feature of the invention, the surface shape of the vacuum insulation panels is produced by the cut-shaping of their supporting bodies formed from polyurethane foam or polystyrene foam or polyisocyanurate foam. The adaption to the surface shape of the inner cladding by cut-shaping avoids a closed outer skin of the support bodies. As a result, the operation of evacuating the vacuum insulation panels can be carried out substantially faster, but can also be performed much more effectively.

In accordance with yet an added feature of the invention, the door and/or the housing have vacuum insulation panels in the heat insulation layer at the inner cladding.

With the objects of the invention in view, there is also provided a refrigerator including a heat-insulating housing, at least one heat-insulating door moveably fastened to the housing, the door and the housing each having an outer cladding, an inner cladding, and a foam-produced heat insulation layer disposed between the outer cladding and the inner cladding, the inner cladding having a heat-insulation side with a panel area, at least one of the door and the housing having a vacuum insulation panel in the heat insulation layer at the panel area of the heat-insulation side of the inner cladding, the panel having a panel surface with a shaping, and means for adapting a surface shaping of the panel area at least approximately to the shaping of the panel surface on the at least one of the door and the housing.

With the objects of the invention in view, there is also provided a refrigerator including a heat-insulating housing, at least one heat-insulating door moveably fastened to the housing, the door and the housing each having an outer cladding, an inner cladding, and a foam-produced heat insulation layer disposed between the outer cladding and the inner cladding, the inner cladding having a heat-insulation side with a panel area, at least one of the door and the housing having a vacuum insulation panel in the heat insulation layer at the panel area of the heat-insulation side of the inner cladding, the vacuum insulation panel having a panel surface with a shaping, and a curable heat insulation foam applied in a liquid state between the inner cladding and the vacuum insulation panel, the foam adapting a surface shaping of the panel area at least approximately to the shaping of the panel surface on the at least one of the door and the housing.

Other features that are considered as characteristic for the invention are set forth in the appended claims.

Although the invention is illustrated and described herein as embodied in a refrigerator, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
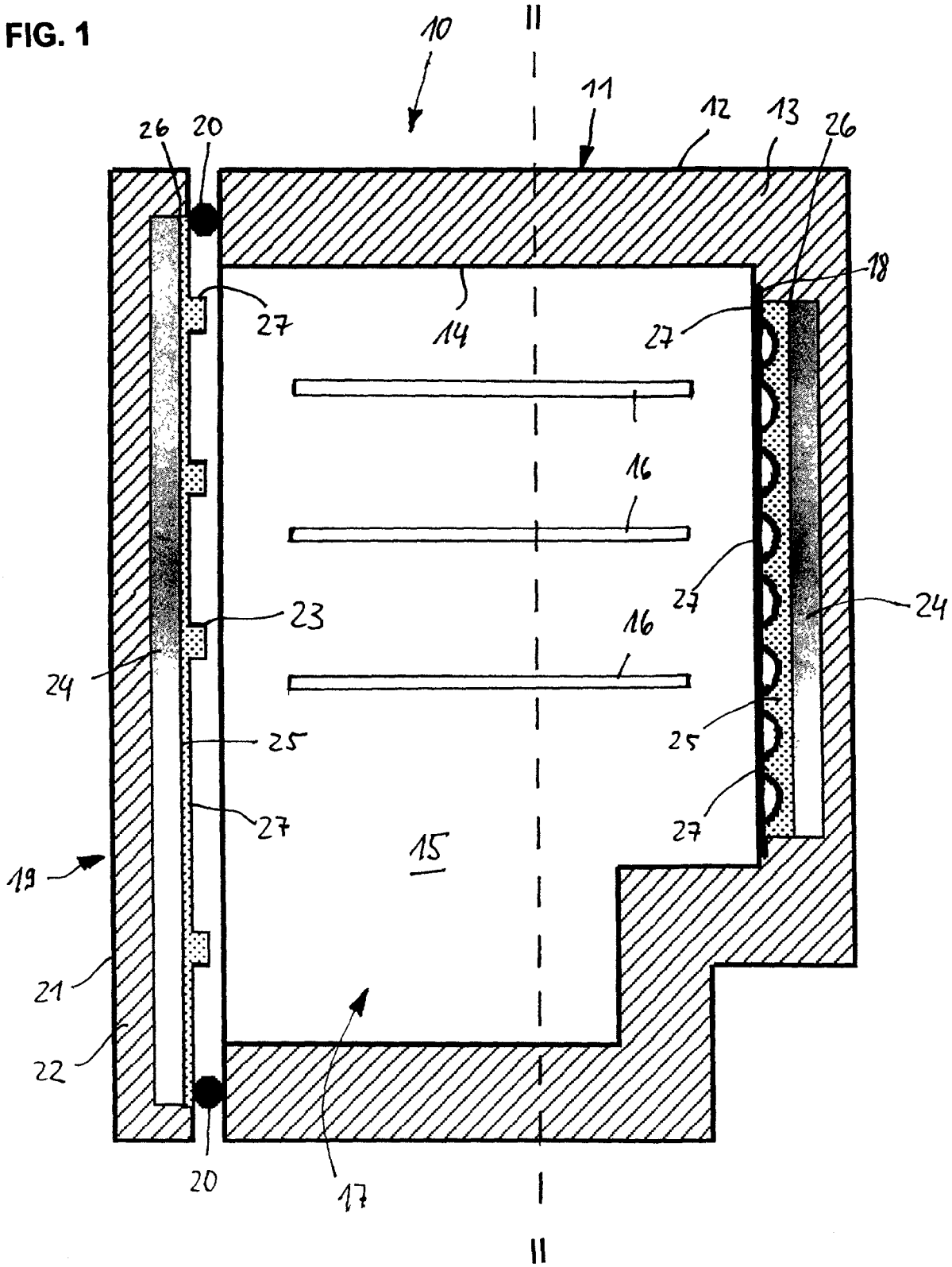
FIG. 1 is a diagrammatic, sectional side view of a table-top chill cabinet with vacuum insulation panels secured on the heat-insulation side to the inner cladding of its door and its housing according to the invention.
Figure 2:
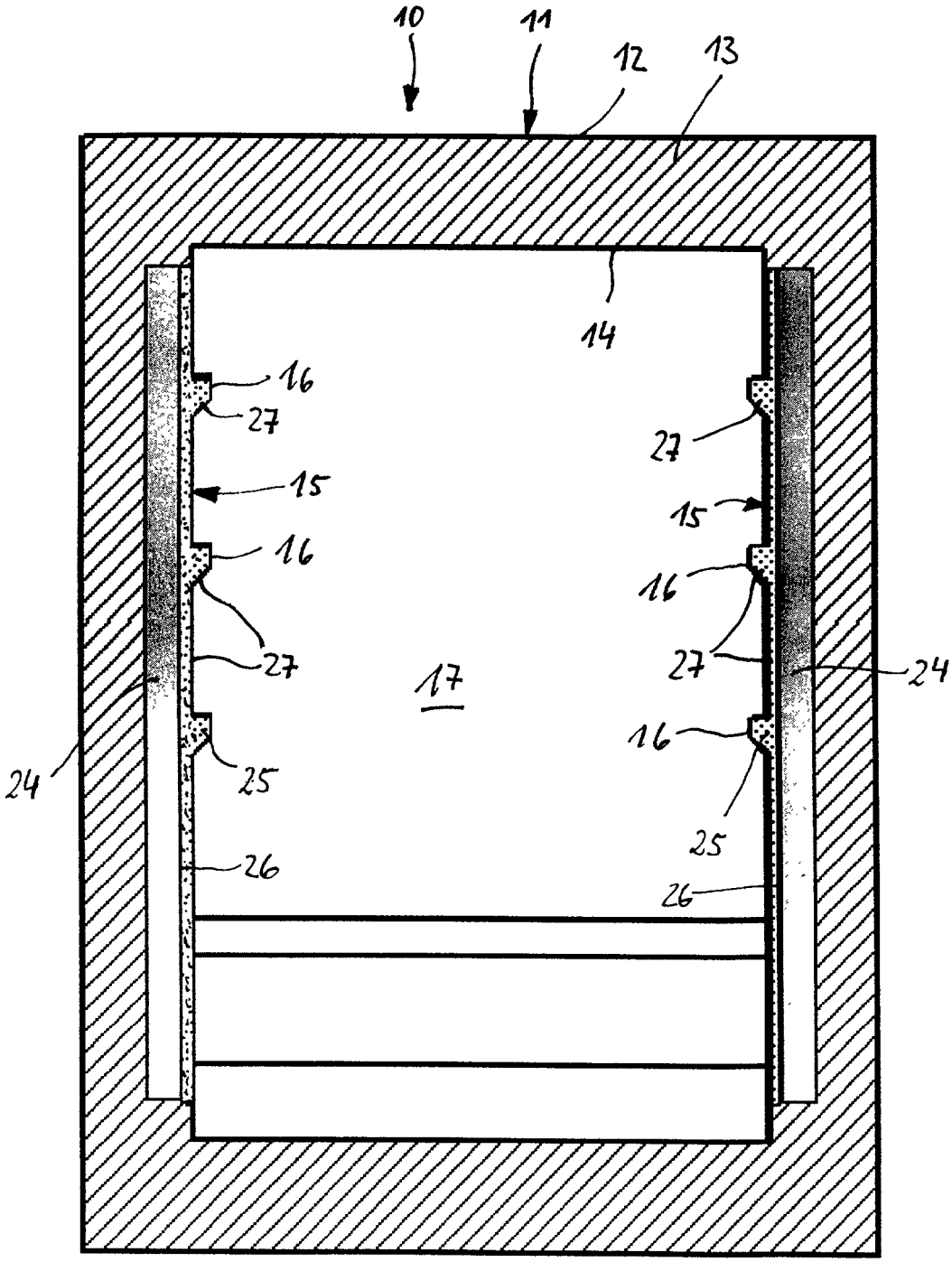
FIG. 2 is a diagrammatic, sectional view of the table-top chill cabinet of FIG. 1 along line II-II.

Referring now to the figures of the drawings in detail and first, particularly to FIGS. 1 and 2 thereof, there is shown, in a simplified diagrammatic illustration, a table-top chill cabinet 10 with a heat-insulating housing 11 that has an outer cladding 12, a heat insulation layer 13 produced by foaming, and a plastic inner cladding 14 that is formed in a non-cutting manner and is connected to the outer cladding 12 by the adhesively acting heat insulation 13 to form a dimensionally rigid body. The inner cladding 14 possesses, on its side walls 15 (see FIG. 2), carrying strips 16 that are integrally formed in a non-cutting manner and are disposed one above the other at approximately equal intervals and that serve as a rest for non-illustrated refrigerated-product shelves. These carrying strips are provided for subdividing a chill space 17 that is lined by the inner cladding 14 and is cooled on its rear wall by what is referred to as a cold-wall evaporator 18 and that is accessible through a door 19 that, in the present exemplary embodiment, is in the closed state. The door 19, in the closed state, rests elastically on the aperture edge of the chill space 17 through a peripheral magnetic seal 20 and, like the housing 11, has an outer cladding 21, a foam-produced, heat insulation layer 22, and a plastic inner cladding 23 formed in a non-cutting manner. The plastic inner cladding 23 possesses, for its reinforcement and for holding non-illustrated door storage compartments, vertically disposed spars that are integrally formed into it in a non-cutting manner and on which are provided holding bosses likewise integrally formed in a non-cutting manner.

To increase the heat insulation efficiency of the door 19 or of the housing 11, vacuum insulation panels 24 are secured, on the heat-insulation side, both to its inner cladding 14 and to the door inner cladding 23 by supporting bodies manufactured, for example, from aerogels, silicic acid, glass fibers, or open-cell foams, such as, for example, polyurethane foam, polystyrene foam, polyisocyanurate foam, or the like. Moldings 25 are provided to fasten the vacuum insulation panels 24. The moldings 25 serve as intermediate layers and are formed from heat insulation material and of which the surface 26 facing the vacuum insulation panels 24 has a planar construction in the same way as the surface of the vacuum insulation panels 24 that is connected thereto over its entire area. Preferably, the moldings 25 are formed from a heat insulation foam applied to the inner cladding 14, 23 as a liquid, with the foam being placed onto the vacuum insulation panels 24 still in the liquid state. Opposite the surface 26, the moldings 25 possess a surface 27 that is adapted to the surface shaping of the door inner cladding 23 or to the surface shaping of the inner cladding 14 and that, in the case of the rear wall, provided with the evaporator 18, of the inner cladding 14, is adapted to the duct pattern of the evaporator 18. The surface shape of the vacuum insulation panel 24 can be a non-cut shaping of its supporting body, or can be a cut shape of the supporting body. The contour-accurate adaption of the molding surface 27 to the respective surface shaping of the inner claddings 14 and 23 or of the evaporator 18 achieves, in the case of the inner claddings 14 and 23, an expedient support of the carrying strips 16 or of the shapes on the door 19. At the same time, the contour-accurate adaptation ensures that, by the moldings 25, the vacuum insulation panels 24 are secured substantially over the entire area at their fastening location and, therefore, during the operation of foaming the heat insulation material 13 or 22 in the housing 11 or the door 19, foaming with high heat insulation quality is achieved while preventing voids that diminish the heat insulation behavior.

Contrary to the exemplary embodiment described, it is also possible to provide the inner cladding 14 of the heat-insulating housing 11 additionally, on the ceiling side and floor side, with a vacuum insulation panel 24 having corresponding surface adaption.

We claim:

1. A refrigerator, comprising:

a heat-insulating housing; and a heat-insulating door fastened to the housing;

at least one of the housing and the door comprising:

an outer cladding;

an inner cladding;

a heat insulation layer between the outer cladding and the inner cladding;

a vacuum insulation panel between the outer cladding and the inner cladding and disposed closer to the inner cladding than the outer cladding; and an intermediate layer provided between a non-planar surface of the inner cladding and a substantially planar surface of the vacuum insulation panel in order to prevent distortions in the outer cladding due to different coefficients of expansion between the vacuum insulation panel and the heat insulation layer, wherein the intermediate layer comprises a shape that is separately molded from the inner surface of the inner cladding.

2. The refrigerator of claim 1, wherein the intermediate layer adapts a surface of the vacuum insulation panel to the non-planar surface of the inner cladding.

3. The refrigerator of claim 1, wherein the intermediate layer comprises a heat insulating layer.

4. The refrigerator of claim 1, wherein the intermediate layer comprises a non-vacuum panel.

5. The refrigerator of claim 1, wherein the intermediate layer comprises a shape that is molded to an inner surface of the inner cladding to have a shape which matches a shape of the non-planar inner surface of the inner cladding.

6. The refrigerator of claim 5, wherein the intermediate layer comprises a shape that is also molded to a surface of the vacuum insulation panel to have a shape which matches a shape of the vacuum insulation panel.

* * * * *